US005419098A

United States Patent [19]

Meier

[11] Patent Number: 5,419,098

[45] Date of Patent: May 30, 1995

[54] METHOD AND APPARATUS FOR CONVEYING TUBULAR PRINTED PRODUCT PACKS AND THEIR GROUPING TO FORM DESPATCH UNITS

[75] Inventor: Jacques Meier, Bäretswil, Switzerland

[73] Assignee: Ferag AG, Hinwil, Switzerland

[21] Appl. No.: 69,019

[22] Filed: May 28, 1993

[30] Foreign Application Priority Data

Jul. 13, 1992 [CH] Switzerland ..... 2195/92

[51] Int. Cl.[6] ..... B65B 35/54; B65B 35/56

[52] U.S. Cl. ..... 53/438; 53/446; 53/447; 53/529; 53/540; 53/544

[58] Field of Search ..... 53/430, 438, 447, 446, 53/436, 118, 528, 529, 523, 409, 204, 540, 542, 544, 531

[56] References Cited

U.S. PATENT DOCUMENTS

| | | | |
|---|---|---|---|
| 2,701,938 | 2/1955 | Murray | 53/446 X |
| 3,537,226 | 11/1970 | LeVan et al. | 53/430 |
| 3,818,674 | 6/1974 | Tull, III | 53/528 |
| 4,730,438 | 3/1988 | Koutonen | 53/409 |
| 4,866,910 | 9/1989 | Reist | 53/430 |
| 5,038,549 | 8/1991 | Nordstrom | 53/447 |
| 5,101,610 | 4/1992 | Honegger | 53/430 |
| 5,230,206 | 7/1993 | Christ | 53/168 X |

FOREIGN PATENT DOCUMENTS 0474999 3/1992 European Pat. Off. .

*Primary Examiner*—James F. Coan

*Attorney, Agent, or Firm*—Walter C. Farley

[57] ABSTRACT

Tubular packs, which contain a wound scale formation of flat products, particularly printed products, are conveyed over predeterminable conveying paths from at least one pack-producing apparatus (W·1, W·2) to at least one forwarding or intermediate storage station (A). For this purpose the packs are conveyed away from the pack-producing apparatus (W·1, W·2) with axes oriented in the conveying direction in a longitudinal conveying direction ($FP_l$). Then in a distributing station (VU) or a deflecting station (U) for distributing the packs to different despatch units and/or for combining the packs into identical despatch units the conveying direction of at least part of the packs, for a constant axial position, is modified by substantially 90° into a transverse conveying direction ($FP_q$). Combined packs can be compressed in a combining station (ZU) and bound together to form double or multiple packs (PP) using a wrapping means. Single, double or multiple packs are so tilted in the forwarding or intermediate storage station (A), that they come to rest on one of their end faces.

14 Claims, 6 Drawing Sheets

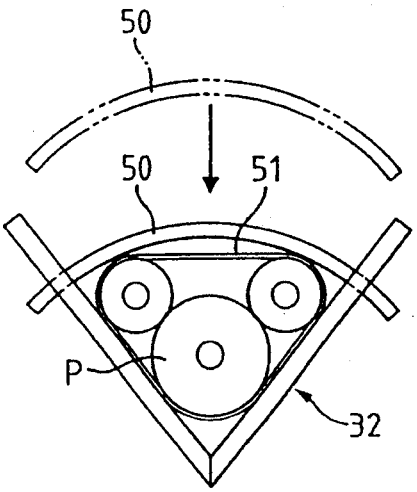
FIG. 5
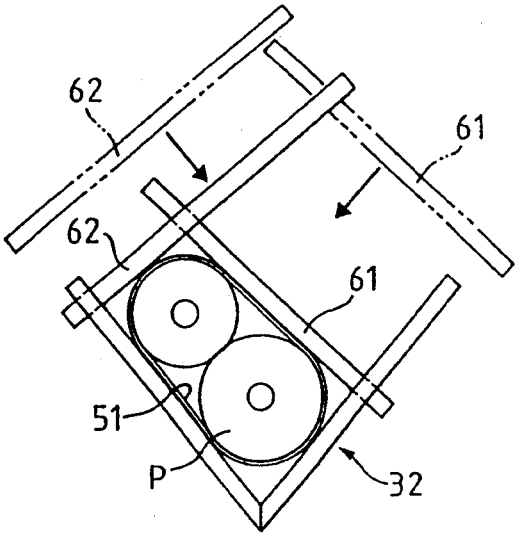
FIG. 6
FIG. 7A
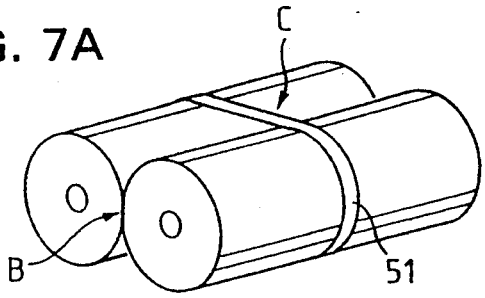
FIG. 7B
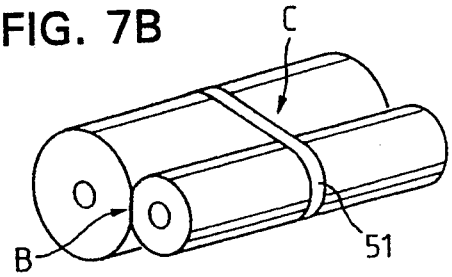
FIG. 7C
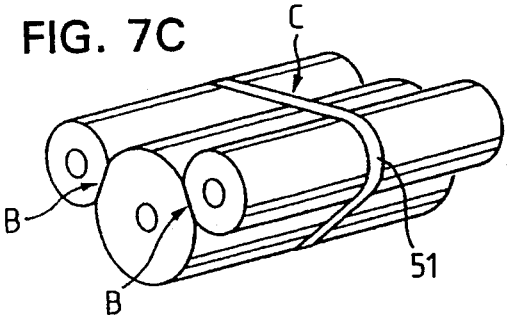
FIG. 7D
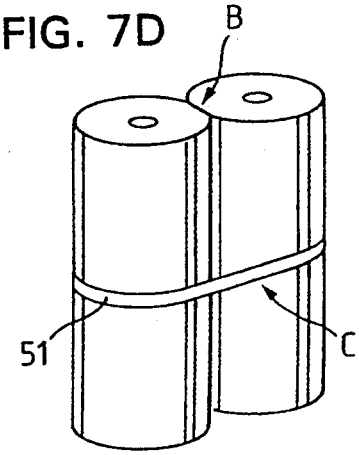

METHOD AND APPARATUS FOR CONVEYING TUBULAR PRINTED PRODUCT PACKS AND THEIR GROUPING TO FORM DESPATCH UNITS

FIELF OF THE INVENTION

This invention is in the field of despatch technology and relates to a method and an apparatus according to which packs, which contain flat products and in particular printed products, such as newspapers or magazines, are conveyed over predeterminable conveying paths and can be grouped into despatch units for forwarding or intermediate storage.

BACKGROUND OF THE INVENTION

According to the prior art, despatch units are formed from printed products, such as newspapers and magazines, by a process in which the printed products delivered in scale formation form are stacked, packed in packing paper or sheeting and then tied to form packs or bales. The apparatus used for this purpose are designed in such a way that the packs have a standardized, maximum size or smaller and that despatch units exceeding the maximum pack size comprise two or more independent packs (standard packs and small packs). If such despatch units comprising several packs are formed by parallel-working machines with optimum utilization, it is not simple to eject in directly succeeding or juxtaposed manner the individual packs which belong to a despatch unit, e.g. having the same address, so that they are usually accumulated and the packs with the same address are sorted out later.

According to a more recent development, flat products and in particular printed products are packed into tubular packs instead of into packs containing stacked products. One method and an apparatus for producing such tubular packs are described in U.S. Pat. No. 5,101,610, Honegger. A scale formation of printed products of a given length are wound onto a mandrel. During the same winding process the tubular roll can be provided with an address sheet, enveloped with a protective sleeve, e.g. formed from a plastics sheet or strong paper, and/or can be bound with string or plastic tape. The finished, tubular pack is then ejected from the winding mandrel in the axial direction.

During the production of tubular packs it is also advantageous to limit the pack size. Thus, when there are large despatch units, it is desirable to produce several tubular packs each having a diameter which is equal to or smaller than a standardized maximum value.

SUMMARY OF THE INVENTION

An object of the invention is to provide a method and an apparatus for conveying tubular packs containing a wound scale formation of flat products, particularly printed products, the resulting packs having a diameter up to a standard maximum diameter, to stations where they are ready to be loaded onto a transportation vehicle or where they are stored temporarily and to simultaneously group the packs into despatch units. The method and corresponding apparatus are intended to make it possible, by using a suitable control means to supply the packs belonging to the same despatch unit simultaneously or indirectly succeeding manner for forwarding or intermediate storage, so that in the case of quasi-continuous conveying the packs belonging to a despatch unit, following conveying, are positioned directly alongside one another in a transportation vehicle or in an intermediate or buffer store. The apparatus for performing the method according to the invention is simple and space-saving.

BRIEF DESCRIPTION OF THE DRAWINGS

The invention is described in greater detail hereinafter relative to non-limitative embodiments and with reference to the attached drawings, wherein:

FIGS. 5 and 6 are end elevations of wrapping devices for combining stations;

FIGS. 7A–7D are perspective views of alternative double and multiple packs;

DESCRIPTION OF THE PREFERRED EMBODIMENTS

Figure 1:
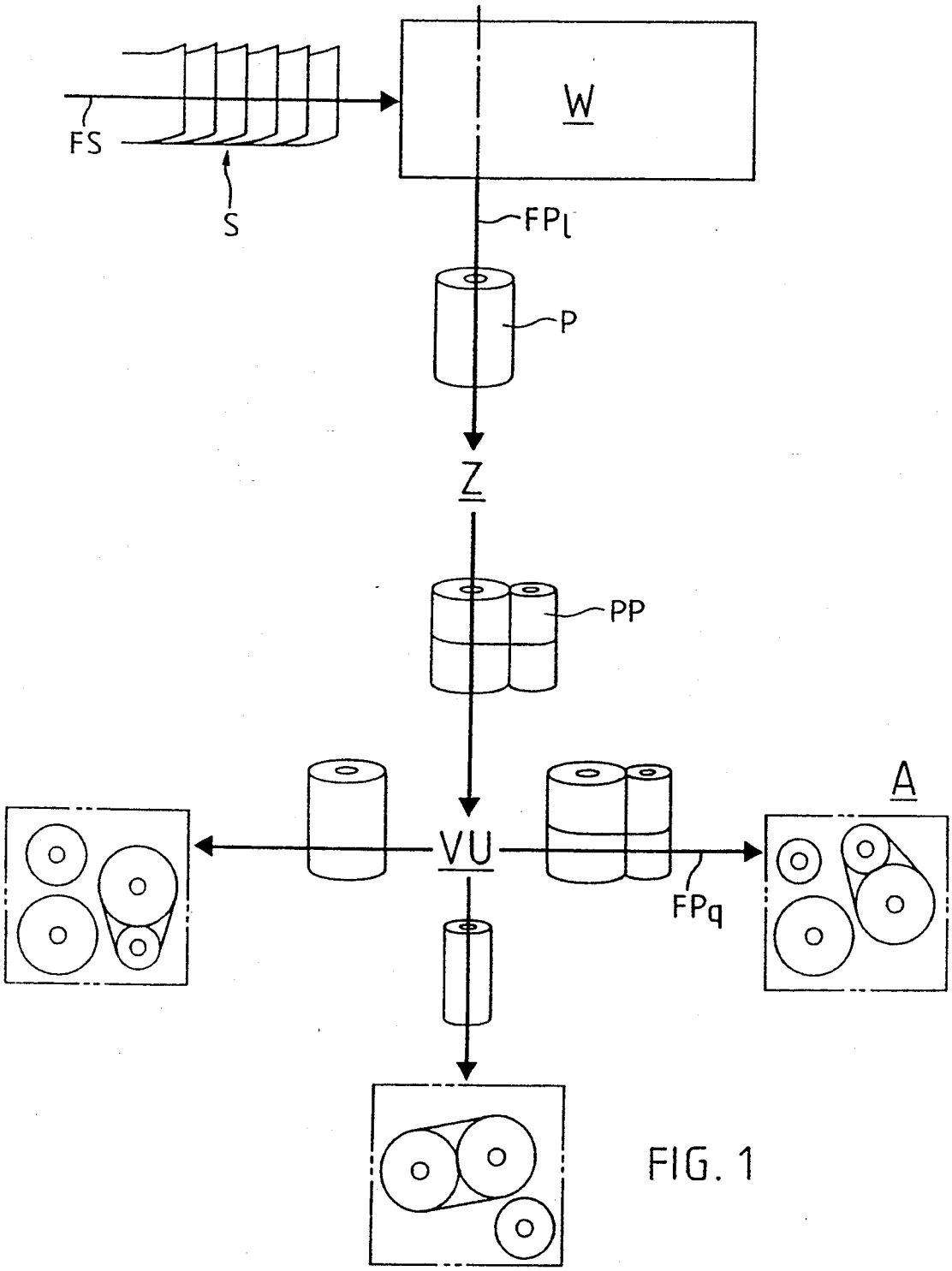
FIG. 1 is a schematic top plan view of an arrangement for performing the method according to the invention, starting from a single pack-producing apparatus.

The method according tO the invention is substantially as follows. The tubular packs are conveyed from a producing apparatus, e.g. a winding station, over predeterminable conveying paths to a forwarding or intermediate storage station, passing through a combining station, in which two or more packs with parallel axes are juxtaposed and combined to form double or multiple packs, in that the packs are pressed together, wrapped around with a wrapping means and held together in this way. They also pass one or more switching points from where they are directed to different loading or intermediate storage stations.

The packs are conveyed from the winding station with their axes oriented parallel with the conveying direction (longitudinal conveying), the spatial positions of the pack axes, at least immediately outside the pack-producing apparatus, being the same as during the winding process. Over the conveying distances up to the forwarding or intermediate storage stations the packs are either conveyed with their axes oriented in the conveying direction (longitudinal conveying) or with their axes oriented transversely to the conveying direction (transverse conveying) and there can be random transitions from one conveying mode to the other and back. Advantageously, the conveying distances or paths are substantially straight portions linked by deflections of substantially 90° where a change is made from one to the other conveying mode. It is also possible to have deflections with a random deflection angle, in which there is no change to the axial position relative to the conveying direction. For longitudinal conveying, it is advantageous to use conveying channels with a V-shaped cross-section. For transverse conveying use can be made of conveyor belts or falling or descending rolling or sliding paths.

For forwarding to a transportation vehicle or for intermediate storage, the packs can be turned or tilted individually or in groups in such a way that they come to rest on one of their end faces. For the tilting of the packs they are conveyed over a rotary link or rotated with the aid of a rotatable tilting mechanism.

The method according to the invention makes it possible in a very simple manner to supply the tubular packs ejected by one or more pack-producing apparatus over predeterminable conveying paths in a predetermined order to one or more transportation vehicles or intermediate stores, so that the packs belonging to a despatch unit, typically consisting of packs having the same address, can be deposited in a closely juxtaposed manner.

The wrapped double or multiple packs have high stability as a result of pressing action, which leads to a flattening of the tubular packs at the contact points. The wrapping means can be held with a hook or hand, which is introduced into one of the gaps between the wrapping means and the tubular packs.

Forwarding or intermediate storage formations with tubular packs standing on the faces are very stable. This is particularly the case if very small packs are combined in the above-described manner with a standard size pack to form a double or multiple pack.

The method according to the invention, compared with corresponding methods for the grouping of stackable packs to form despatch units provides several advantages. Because the tubular packs can be produced in the same apparatus starting from a scale formation, there are no intermediate conveying arrangements with unstable formation, such as loose stacks or small packs superimposed on one another. Because the packs can be supplied in a predetermined order in a quasi-continuous manner for forwarding or intermediate storage, there are no accumulation belts needed nor manual inspection and sorting of any one shipment.

Figure 2:
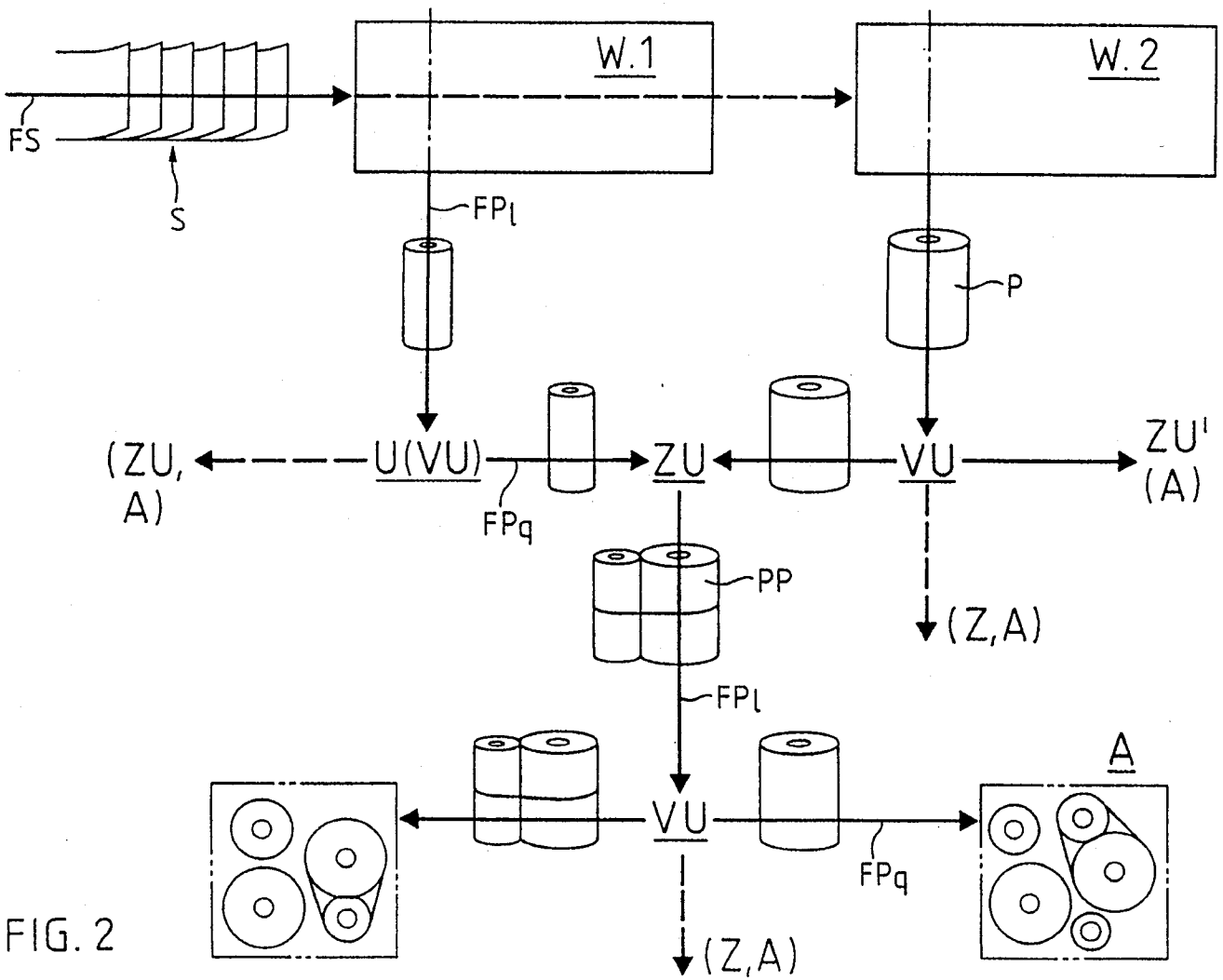
FIG. 2 is a schematic top plan view, similar to FIG. 1, of an arrangement for performing the method according to the invention, starting with two pack-producing apparatus.

FIGS. 1 and 2 show two typical uses of the method according to the invention in a bird's eye view.

FIG. 1 relates to a system starting from a single pack-producing apparatus, such as a winding station W. A scale flow S passes into winding station W. Tubular packs P are conveyed out of winding station W transversely to the conveying direction FS of the scale flow S. The pack axes are parallel to the conveying direction $FP_{[1]}$ (longitudinal conveying). The packs P are passed from winding station W into a combining station Z, at which a pack can wait for one or more following packs and then the individual packs are combined by pressing and wrapping with a wrapping means to form a double or multiple pack PP. Individual, double or multiple packs P/PP are conveyed out of combining station Z in the longitudinal conveying direction $FP_{[1]}$ to a switching point VU. For directing packs to different despatch units or to different transportation vehicles or intermediate store, at least part of the packs are deflected at switching point VU with a substantially constant axial position by approximately 90° to transverse conveying with a direction $FP_{[q]}$ and are conveyed to a forwarding or intermediate storage station A, where the packs are tilted in such a way that they come to rest on one of their faces.

Specific embodiments of apparatus usable as combining station Z and switching points VU will be described in conjunction with FIGS. 3 to 6 and 8 to 10.

Further possible variations based on the method shown in FIG. 1 are:

- there is no switching point VU, so that the single, double or multiple packs P/PP are conveyed from the combining station Z to a single forwarding or intermediate storage station A;
- the combining station Z and the switching point VU are arranged in reverse order, the packs being conveyed from the switching point VU to other combining stations or to other forwarding or intermediate storage stations;
- a switching point VU is provided upstream and downstream of the combining station Z in the conveying direction;
- there are no combining station Z or switching point VU, so that the individual packs are directly conveyed from the winding station W in the longitudinal conveying direction $FP_{[1]}$ to a single forwarding or intermediate storage station;
- the packs P/PP are not tilted for forwarding or intermediate storage and are instead loaded or stored with substantially horizontal axes.

FIG. 2 shows another embodiment of the method based on two pack-producing apparatuses W-1 and W-2. Because the method diagram uses the same basic steps and components as that of FIG. 1, elements having the same function are given the same reference numerals.

A scale flow S passes into two winding stations W-1 and W-2, said winding stations typically functioning in such a way that the scale flow is wound in one station, whereas in the other station a pack is finished off and ejected. Packs P are conveyed away from both stations in the longitudinal conveying direction $FP_{[1]}$.

At a deflection point U, which can also be constructed to function as a switching point VU, at least part of the packs, without changing their axial positions, are deflected by substantially 90° and conveyed into one or more combining stations ZU or ZU' where they are combined with packs belonging to the same despatch unit from the same or the other pack-producing apparatus and are joined together by wrapping. It is also possible to convey the packs directly in the longitudinal conveying direction $FP_{[1]}$ into the combining stations ZU, ZU', a variation which is not illustrated in FIG. 2.

As in the method according to FIG. 1, the individual or combined packs P/PP are conveyed from a combining station ZU to a further switching point VUin the longitudinal conveying direction $FP_{[1]}$ where at least part of them are deflected by again substantially 90° so as to be conveyed to the different forwarding or intermediate storage stations A, where the packs P/PP are tilted in the already described manner and placed on one of their end faces.

As can be gathered from FIG. 1 and the method variations mentioned in conjunction therewith, together with FIG. 2, the winding stations W, combining stations Z/ZU, deflecting points U and switching points VU can be combined in a Large number of permutations to form appropriate systems. Criteria for this are provided in FIG. 2 by the broken line arrows and the additional bracketed combining stations Z/ZU deflecting points U or switching points VU. Each conveying path ends at a forwarding or intermediate storage station A, where the single, double or multiple packs P/PP can be tilted into a position with a vertical axis. The forwarding stations are advantageously arranged in such a way that a transportation vehicle can pass below them, so that the packs can be tilted directly onto a loading bridge or on a pallet placed thereon. The intermediate storage stations can in particular be constituted by a specially designed pallet, on which the packs can be intermediately stored in the manner shown in FIG. 11.

In FIGS. 1 and 2 all parts of the conveying path are shown as being straight. However, as already stated, it is also possible to have curves to accommodate local conditions, where the relative position of the pack axes with respect to the conveying direction is virtually unchanged.

Figure 3:
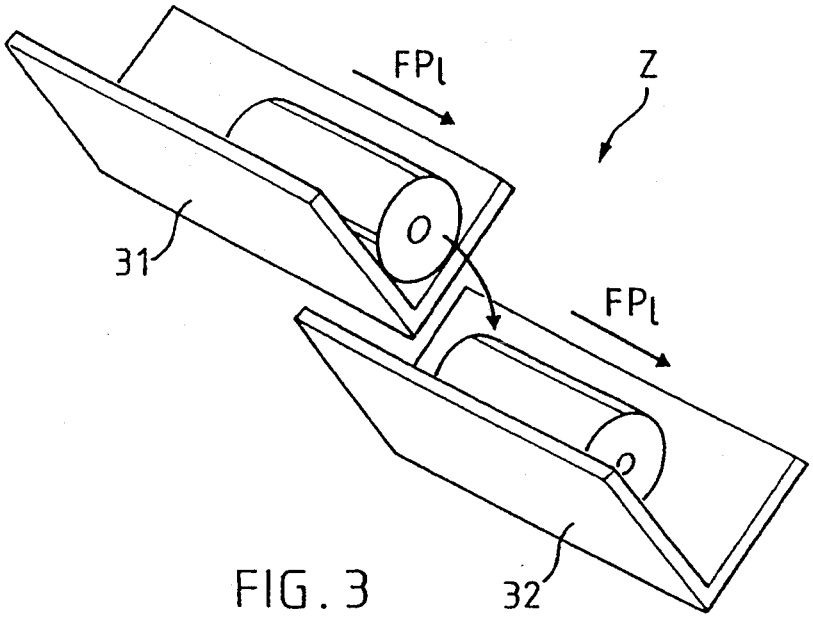
FIG. 3 is a perspective view of an apparatus for a bringing-together or combining station.

FIG. 3 diagrammatically shows an apparatus for a combining station Z according to FIG. 1 in the form of two portions of V-shaped conveying channels for a longitudinal conveying with a conveying direction $FP_{[1]}$ and which together form the combining station Z. The walls of such conveying channels are advantageously provided with conveyor rollers, not shown. For downwardly directed conveying paths, the conveyor rollers are freely rotatable and the packs are conveyed by their own gravity. For horizontal or slightly rising configurations of the conveying channel, the conveyor rollers must be driven.

As shown, the combining station Z can be formed by a step-like arrangement of two V-shaped conveying channels, the packs dropping from a supply channel 31 into a discharge channel 32. Conveying in the first part of the discharge channel 32 is controllable such as by controllable conveyor rollers or by braking means, not shown, in such a way that a pack can wait there for one or more further packs. At the location of the discharge channel 32 there is a wrapping means, not shown, whose function will be described in greater detail in conjunction with FIGS. 5 and 6.

Instead of the packs dropping into a discharge channel from a supply channel, which terminates at the combining station Z in the manner shown in FIG. 3, the supply channel can also be provided with a controllable flap, which opens in controlled manner when a pack to be passed into the combining station is supplied. Other packs can be conveyed in the longitudinal conveying direction over the closed flap. The function of the controllable flap can also be assumed by a corresponding lifting platform, which raises the packs to be combined into a higher discharge channel. The discharge channel need not necessarily start in the combining station Z in the manner shown in FIG. 3. It is also conceivable that part of the packs will be conveyed via the discharge channel into the combining station Z, where they are then combined into double or multiple packs with packs coming from the supply channel.

Figure 4:
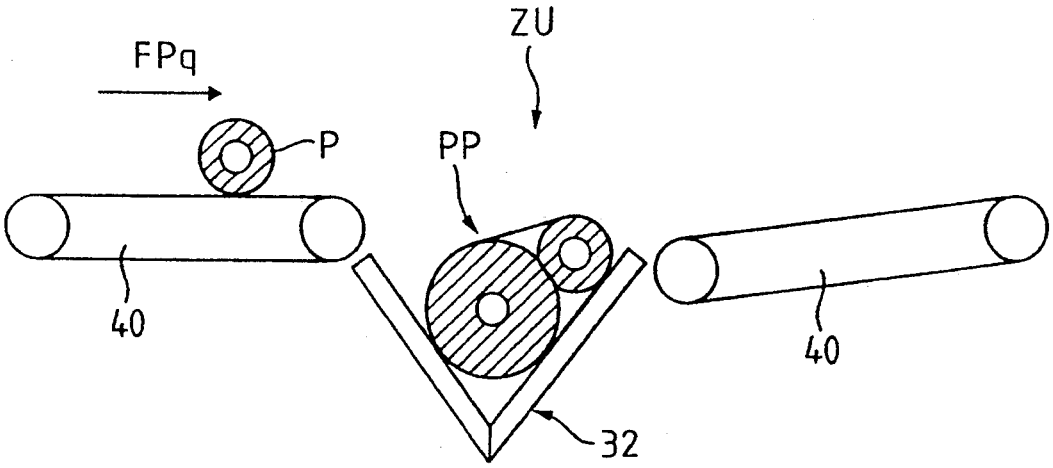
FIG. 4 is a side elevation, partly in section, of an embodiment of a combining station.

FIG. 4 shows, as a section at right angles to a longitudinal conveying direction $FP_{[1]}$, an embodiment of an apparatus for a combining station ZU according to FIG. 2. The combining station ZU differs from the combining station Z (FIGS. 1 and 3), in that the supply of the packs takes place in the transverse conveying direction $FP_{[q]}$ whereas the discharge or removal also takes place in the longitudinal conveying direction $FP_{[1]}$, i.e. on combining, the packs are also deflected.

From two transverse conveying means, such as conveyor belts 40 or falling rolling sections, individual packs P are conveyed in the transverse conveying direction $FP_{[q]}$ into the V-shaped discharge channel 32. As described in conjunction with FIG. 3, the discharge channel 32 is equipped for the combining, pressing and wrapping of the packs to form double or multiple packs PP.

FIGS. 5 and 6 diagrammatically show (in a section at right angles to the longitudinal conveying direction) two embodiments for wrapping means, as provided in the discharge channel (32 in FIGS. 3 and 4) of combining stations. As stated, the individual packs brought together in the combining station are first compressed and then wrapped, so that a double or multiple pack is formed from two or more individual packs, in which the packs are flattened at the contact surfaces and are consequently very stable in their reciprocal position.

FIG. 5 shows an apparatus for producing triple packs. For pressing the three packs against one another a downwardly concavely curved pressure beam 50 is moved from a rest position, shown in dot-dash line form, in the direction of the arrow toward the discharge channel 32 and into a pressure or pressing position shown in continuous line form. The packs in channel 32 are pressed against one another between discharge channel 32 and pressure beam 50 and are wrapped around at least once in this state by wrapping means 51, e.g. string or plastic band. Apparatus for applying the wrapping means 51 are known in conjunction with the wrapping of stacked packs. Therefore there is no need to show or describe such means here.

FIG. 6 shows a further embodiment of an apparatus for producing double or multiple packs. It has two substantially planar pressure beams 61, 62. One beam 61, in the shown position of the individual packs, has the function of stabilizing the packs in this position, whereas the other beam 62 performs the actual pressing function. It is also conceivable for the two pressure beams 61, 62 to be combined into an angled, single pressure beam. As described in conjunction with FIG. 5, for the pressing process the two pressure beams 61, 62 are moved from an inoperative position (shown in dot-dash line form) into a pressing position (shown in continuous line form).

FIGS. 7A–7D show examples of double or multiple packs, which are formed by combining two or more individual packs with the aid of the wrapping means 51. At the points designated B, flattened contact surfaces between the individual packs are visible. At the points designated C the wrapping means is not in contact with either of the packs, so that at these points the double or multiple pack can be engaged with a hook or a hand.

Figure 8:
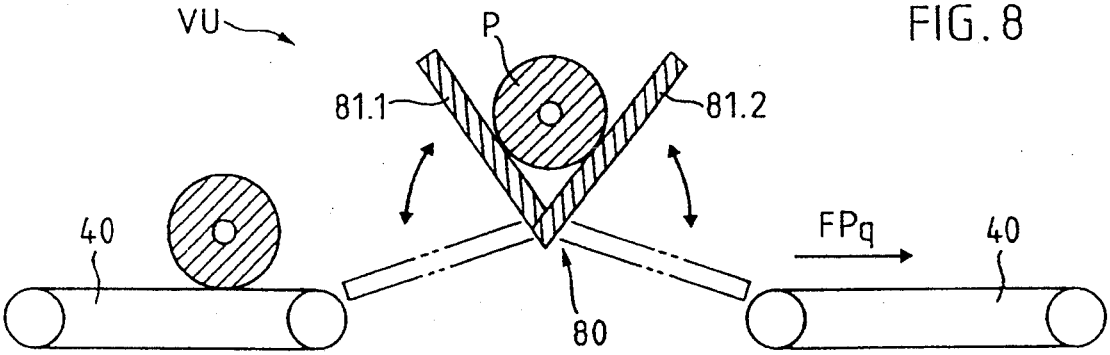
FIG. 8 is a side elevation of an embodiment of an apparatus for a distributing station or switching point in partial section perpendicular to the longitudinal conveying direction.

FIG. 8 diagrammatically shows an apparatus for a switching point VU, the drawing being a section perpendicular to the longitudinal conveying direction. FIG. 8 shows a V-shaped conveying channel 80 in which packs P are conveyed in the longitudinal conveying direction (perpendicular to the plane of the paper) to the switching point. The conveying channel 80 can, e.g., be an exit channel from a pack-producing apparatus, a discharge channel of a combining station (32, FIG. 3) or the extension of the supply channel of a combining station (31, FIG. 3). In the same way the conveying channel 80 passing out of the switching point VUcan again lead into a combining station Z/ZU or to a further deflecting point U or switching point VU.

At the switching point VU, conveying channel 80 e.g. has on each side a controlled, downwardly tiltable wall part 81.1 and 81.2 (shown in the tilted down position in dot-dash line form), which enables a pack to laterally roll onto a transverse conveying means (conveying direction $FP_{[q]}$), e.g., onto a conveyor belt 40 or a corresponding, downward roller section.

For a deflecting point U the wall of the conveying channel 80 is closed on one side, is permanently open on the other side and to the latter side is only connected a transverse conveying means. From the transverse conveying means connected to a switching point the packs are passed to a combining station ZU (cf. FIGS. 2 and 4) or to a forwarding or intermediate storage station.

As can be gathered from FIG. 8, the conveyor belts 40 as transverse conveying means can be omitted, so that then the tilted or flapped down wall parts 81.1 and 82.2 (shown in dot-dash line form) of the deflecting or switching points constitute the only transverse conveying means, to which can be directly connected a combining station ZU or a forwarding or intermediate storage station.

Figure 9:
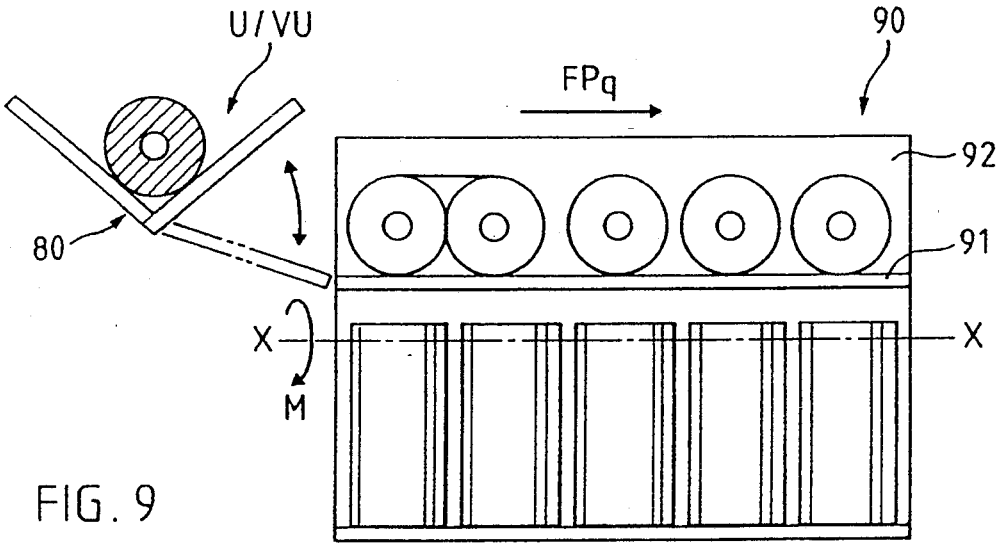
FIG. 9 is a side elevation of an apparatus for tilting the packs for despatch or intermediate storage, in a view parallel to the axes of the supplied packs.
Figure 10:
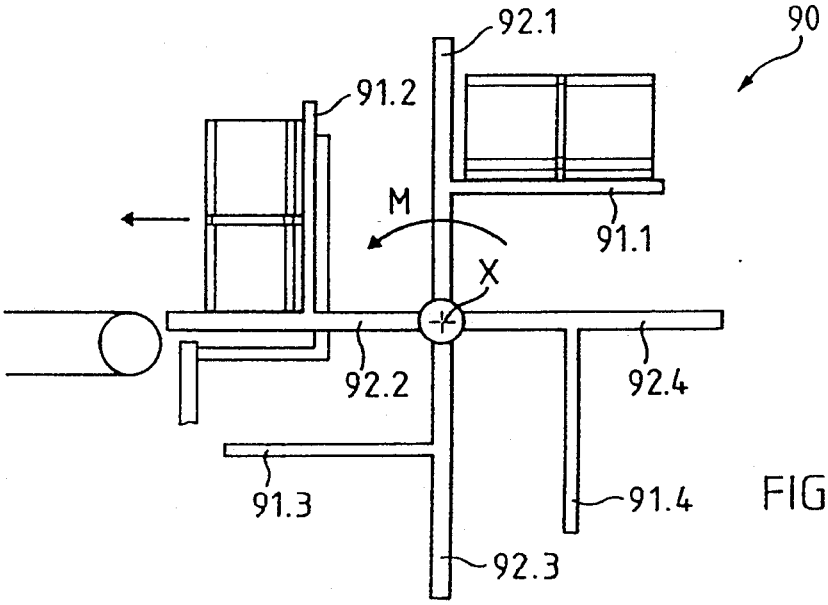
FIG. 10 is an end elevation, perpendicular to the axes, of the apparatus of FIG. 9.

FIGS. 9 and 10 show an embodiment of an apparatus 90 for tilting packs into a position standing on one face and, according to the invention, for forwarding or intermediate storing. In FIG. 9 the apparatus is shown parallel to the axes of the supplied packs and in FIG. 10 perpendicular to the transverse conveying direction $FP_{[q]}$. The apparatus is used for tilting packs being supplied in the transverse conveying direction $FP_{[q]}$, i.e. on a transverse conveying means or directly from a deflection point U or a switching point VU. The packs roll or slide from the V-shaped channel 80 of the deflecting or switching point U/VU, or from a transverse conveying means, into a frame rotatable in step-wise manner about a rotation axis X with four pairs of bearing surfaces 91 and 91, arranged in beam-like manner to the axis and which are substantially perpendicular to one another. The packs roll or slide on one of the bearing surfaces and then when the frame is rotated (arrow M), are tilted from the bearing surface 91.1, 91.2, 91.3 or 91.4 corresponding other bearing surface 92.1, 92.2, 92.3 or 92.4 and then stand on one end face. For tilting packs supplied in the longitudinal conveying direction, the packs need merely be conveyed over corresponding tilting templates for bringing them into a position with a vertical axis.

Figure 11:
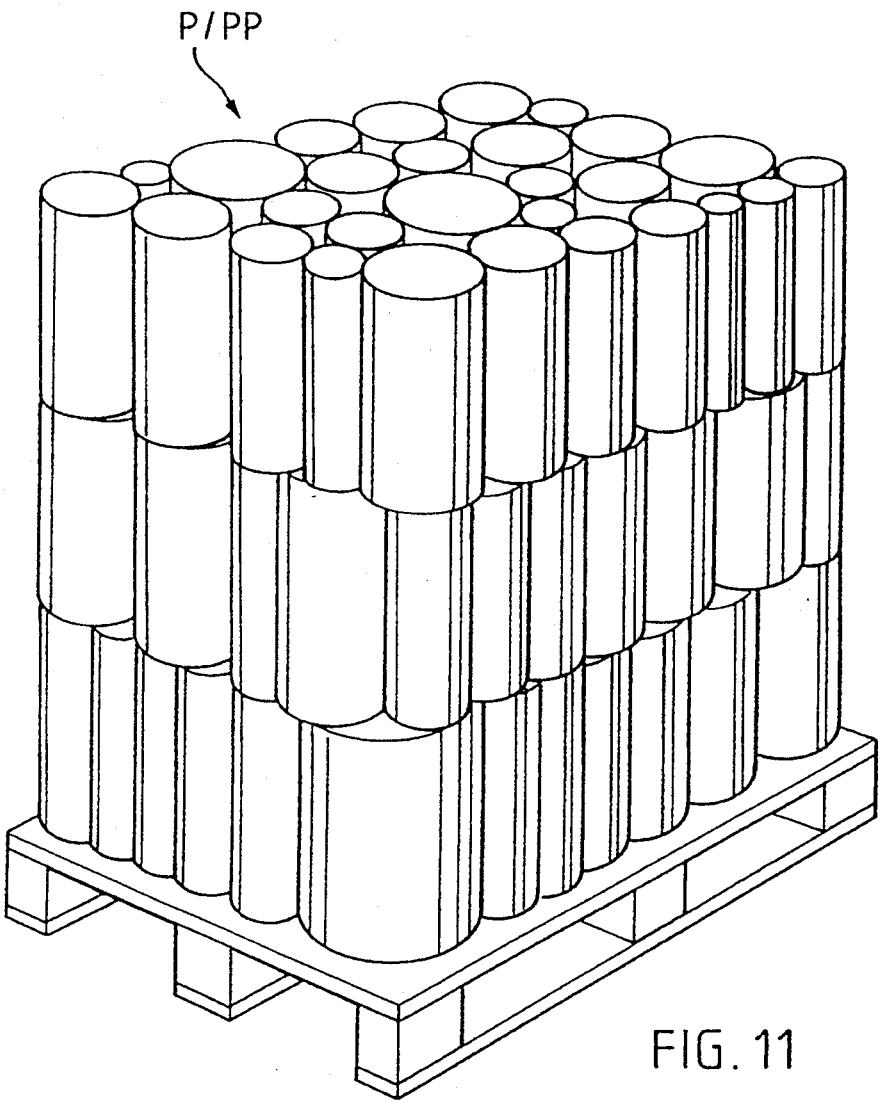
FIG. 11 is perspective view of an intermediate store for tubular individual, double and/or multiple packs.

As stated, FIG. 11 shows tubular single, double and/or multiple packs P/PP stacked for transportation purposes or intermediately stored on a pallet. Such formations are very stable, even though they may contain packs with small diameters, which are, however, integrated into a double or multiple pack.

I claim:

1. A method for conveying each of a plurality of tubular packs, each containing a plurality of printed products in the form of a wound-up scale formation, wherein the packs are ejected axially and in series from at least one pack-producing apparatus, to a destination selected from a plurality of despatch or intermediate storage stations, comprising the steps of:

providing a plurality of paths from the at least one pack-producing apparatus to the plurality of despatch or intermediate storage stations, interlinking the paths with at least one switching point selectively switchable to define one of the plurality of paths at a time, providing on a conveying path at least one combining station for combining a plurality of packs into a single pack unit by wrapping a binding means around at least two packs placed together with parallel central axes, switching the at least one switching point to define a path for each pack or unit to a selected destination among the plurality of despatch or intermediate storage stations, and conveying each single pack and unit along its selected path with each pack axis parallel or perpendicular to a direction of conveyance, the orientation of the axis being changeable at each switching point or combining station.

2. A method according to claim 1 and including compressing juxtaposed packs in the combining station before wrapping to flatten common contact surfaces thereof.

3. A method according to claim 1 and including changing the conveying direction of each pack by substantially 90° from axial conveying to lateral conveying while holding the axial spatial orientation of the packs constant.

4. A method according to claim 1 and including tilting each said pack or unit and positioning the pack or unit on an end face of the pack or unit.

5. A method according to claim 1 and including tilting each said pack or unit and positioning the pack or unit on an end face of the pack or unit at an intermediate storage station.

6. A method according to claim 5 wherein each pack and unit conveyed to the intermediate storage station is conveyed with the pack axes perpendicular to the conveying direction and, at the intermediate storage station, tilting the packs and units singly or in groups onto end faces thereof.

7. An apparatus for conveying a plurality of tubular packs, each containing a plurality of printed products in the form of a wound-up scale formation, wherein the packs are ejected axially and in series from at least one pack-producing apparatus, to a destination selected from a plurality of despatch or intermediate storage stations, comprising a plurality of conveying paths linking a pack-producing apparatus with a plurality of destinations, said paths including conveying sections with longitudinal conveying means for conveying said packs with axes parallel to a direction of conveying, and transverse conveying means for conveying said packs with axes perpendicular to said direction of conveying;

switching means for interlinking said plurality of conveying paths, said conveying means upstream of said switching point being one of said longitudinal or transverse conveying means and said conveying means downstream of said switching point being the other of said longitudinal or transverse conveying means; and at least one combining station located on a conveying path, said at least one combining station comprising means for stopping packs, means for juxtaposing a plurality of packs with central axes of said packs parallel and end faces thereof substantially coplanar, and means for binding said plurality of juxtaposed packs together into a pack unit.

8. An apparatus according to claim 7 wherein said longitudinal conveying means includes V-shaped conveying channels.

9. An apparatus according to claim 7 wherein said at least one combining station includes means for pressing said juxtaposed packs together whereby mutual contact surfaces of said packs are flattened.

10. An apparatus according to claim 7 wherein said longitudinal conveying means includes a V-shaped conveying channel and a deflecting station at an outlet location of said channel, said conveying channel at said deflecting station having a wall of said channel open to the side, and wherein a transverse conveying means removes packs passing through said side.

11. An apparatus according to claim 7 wherein said transverse conveying means are selected from conveyor belts and roller or sliding surfaces descending in the conveying direction.

12. An apparatus according to claim 7 and including a distribution station comprising a V-shaped conveying channel with at least one wall part tiltable to discharge a pack from said conveying channel into a further conveyor to a selected destination.

13. An apparatus according to claim 7 and including forwarding and intermediate storage stations including means for tilting packs from a substantially horizontal axis position to a substantially vertical axis position in which a pack rests on an end face.

14. An apparatus according to claim 13 wherein said means for tilting includes means having substantially perpendicular surfaces and a rotation axis, said pack being received on one said surface and tilted to another surface upon rotation of said means for tilting about said rotation axis.

* * * * *